US005168287A

United States Patent [19]

Okunomiya et al.

[11] Patent Number: 5,168,287

[45] Date of Patent: Dec. 1, 1992

[54] PLATEN LOCKING MECHANISM FOR THERMAL TRANSFER RECORDING APPARATUS

[75] Inventors: Seiji Okunomiya; Youichi Narui, both of Katsuta; Masami Takada, Naka; Naohiro Ozawa, Yokohama, all of Japan

[73] Assignee: Hitachi, Ltd., Tokyo, Japan

[21] Appl. No.: 639,130

[22] Filed: Jan. 9, 1991

[30] Foreign Application Priority Data

Jan. 10, 1990 [JP] Japan ..... 2-1512

[51] Int. Cl.[5] ..... B41J 13/22; B41J 2/32

[52] U.S. Cl. ..... 346/76 PH; 346/138; 400/120; 400/185; 400/187; 400/648; 271/277

[58] Field of Search ..... 346/76 PH, 134, 138; 400/120, 185, 186, 187, 642, 643, 645, 645.4, 648; 271/277, 10, 275, 114, 266

[56] References Cited

U.S. PATENT DOCUMENTS 3,884,461 5/1975 Hauser ..... 346/138
4,135,198 1/1979 Fujimoto ..... 346/138
4,884,909 12/1989 Watanabe et al. ..... 400/625
5,026,180 6/1991 Tajima et al. ..... 346/138

FOREIGN PATENT DOCUMENTS 0116187 12/1983 European Pat. Off. .
0180370 10/1985 European Pat. Off. .
0216350 9/1986 European Pat. Off. .
0206065 8/1988 Japan .

*Primary Examiner*—Benjamin R. Fuller
*Assistant Examiner*—Huan Tran
*Attorney, Agent, or Firm*—Antonelli, Terry, Stout & Kraus

[57] ABSTRACT

A thermal transfer recording apparatus wherein printing on record paper is performed with the record paper fixed on a platen roller is constituted such that, when the record paper is to be fixed, transmission of power to the platen roller is interrupted and the platen roller is fixedly held at a predetermined position, which enables realization of a transporting system for a transport system of a thermal transfer recording apparatus of the record paper fixing type which system includes a single motor therein.

2 Claims, 6 Drawing Sheets

PLATEN LOCKING MECHANISM FOR THERMAL TRANSFER RECORDING APPARATUS

FIELD OF THE INVENTION

The present invention relates to a recording apparatus of a thermal transfer type and, more particularly, to a platen locking mechanism suitable for use with platen roller driving means of the type wherein the printing is performed on recording paper fixed to a platen roller.

BACKGROUND OF THE INVENTION

A thermal transfer recording apparatus records on record paper by pressing ink paper and the record paper with the ink paper positioned outwardly of the record paper against a platen roller and heating the ink paper from above with a thermal head.

In such thermal transfer recording apparatus, the record paper is fixedly held in most cases on the platen roller using a fixing element in order to assure the accuracy in position of transfer record. In an apparatus of the type mentioned which employs such conventional system, supplying and discharging of record paper, winding of ink paper and so forth are performed by individual motors separate from a motor for the rotational driving of the platen roller.

An apparatus as described above is disclosed in, for example, Japanese Utility Model Application Laid-Open No. 62-109953 and Japanese Utility Model Application Laid-Open No. 63-60343.

Such conventional apparatus requires motors for the exclusive use for supplying and discharging of record paper, winding of ink paper and so forth and involves large scale motor driving circuits thereby increasing the cost of the apparatus.

SUMMARY OF THE INVENTION

It is an object of the present invention to provide a thermal transfer recording apparatus which eliminates such drawbacks of conventional apparatus as described above and wherein a fixing mechanism for record paper for which a plurality of motors for the exclusive use have been employed in a conventional thermal transfer recording apparatus includes a single motor by which rotational driving of a platen roller, supplying and discharging of record paper, winding of ink paper and so forth can be realized.

In a thermal transfer recording apparatus according to the present invention, a system for transmitting rotational power to a platen roller has a platen roller non-driving position at which rotational power is not transmitted to the platen roller, and rotation of the platen roller is prevented upon supplying or discharging of record paper and so forth.

Further, also driving for transporting record paper from the platen roller to a record paper fixing mechanism section is performed by a platen roller driving motor so that considerable reduction in cost of the mechanisms and electric circuits can be realized without the necessity of a motor for the exclusive use for the supplying and discharging of paper.

DESCRIPTION OF PREFERRED EMBODIMENT

An embodiment of the present invention will be described with reference to FIGS. 1 to 14. FIGS. 2 to 5 are schematic views showing a platen roller of a thermal transfer recording apparatus around for winding record paper therearound.

Figure 3:
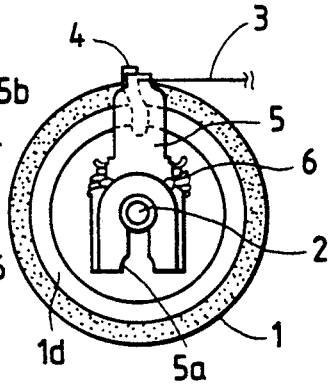
FIG. 3 is a right-hand side elevational view of the platen roller of FIG. 2.
Figure 4A:
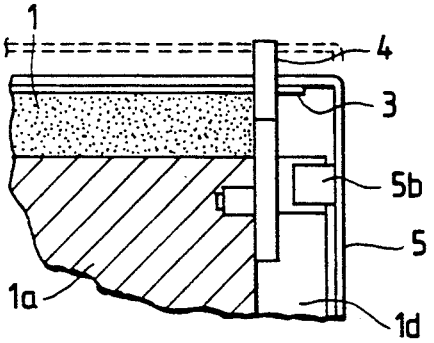
FIG. 4(A) is an enlarged view of a right portion of FIG. 2.
Figure 4B:
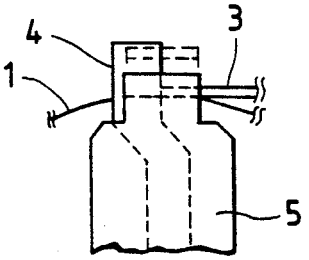
FIG. 4(B) is a right-hand side elevational view of the portion shown in FIG. 4(A)
Figure 5:
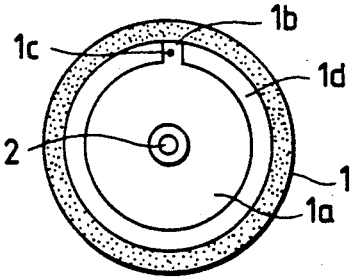
FIG. 5 is a side elevational view of a platen roller body.
Figure 6:
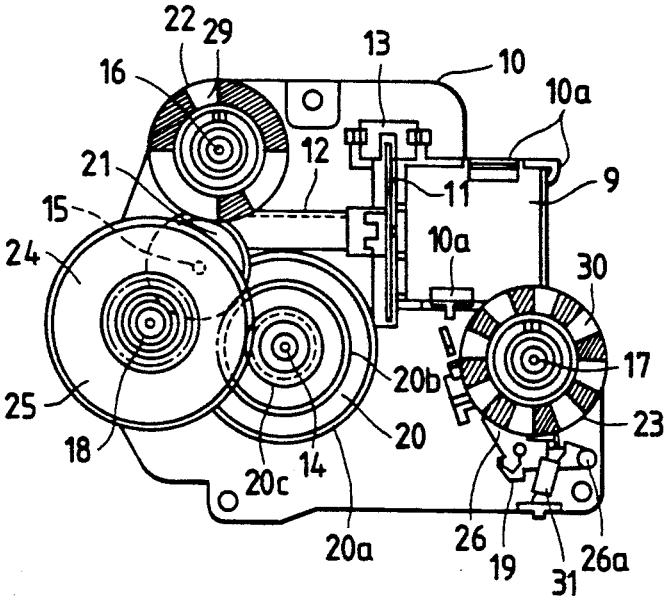
FIG. 6 is a front elevational view of a gear block of a rotational driving system.

A platen roller 1 includes a rubber member formed in a cylindrical profile on a core 1*a*, and a shaft 2 secured to the core 1*a* and serving as a rotary shaft for the platen roller 1. A pair of circular projecting ribs 1*d* are provided on the opposite end faces of the core 1*a* and are partially cut away toward the center of rotation of the platen roller 1 to form recessed portions 1*b* in an opposing relationship to each other. A force fitting hole 1*c* having a fixed depth is provided on a face of each of the recessed portions 1*b*. A pair of stoppers 4 for a record paper positioning member which is securely mounted in the force fitting holes 1*c* extend outwardly from an outer periphery of the platen roller 1, and such stoppers 4 are mounted in an opposing relationship to each other on the opposite end faces of the platen roller 1. A fixing arm 5 of a record paper fixing member for fixing an end portion of record paper 3 having a sufficient width to allow the record paper 3 to contact with the pair of stoppers 4 against the outer periphery of the platen roller 1 along the direction of the shaft 2 has formed on the opposite end faces thereof a pair of grooves 5*a* for fitting with the shaft 2 and a pair of projected portions 5*b* for fitting with the recessed portions 1*b*. A pair of springs 6 are each mounted in a substantially U-shape around the shaft 2 on the fixing arm 5. The fixing arm 5 is mounted for movement in a radial direction of the platen roller 1 as seen in FIG. 3. A pair of steps 2*a* for positioning the fixing arm 5 in its thrust direction are formed on the opposite ends of the shaft 2.

Figure 1:
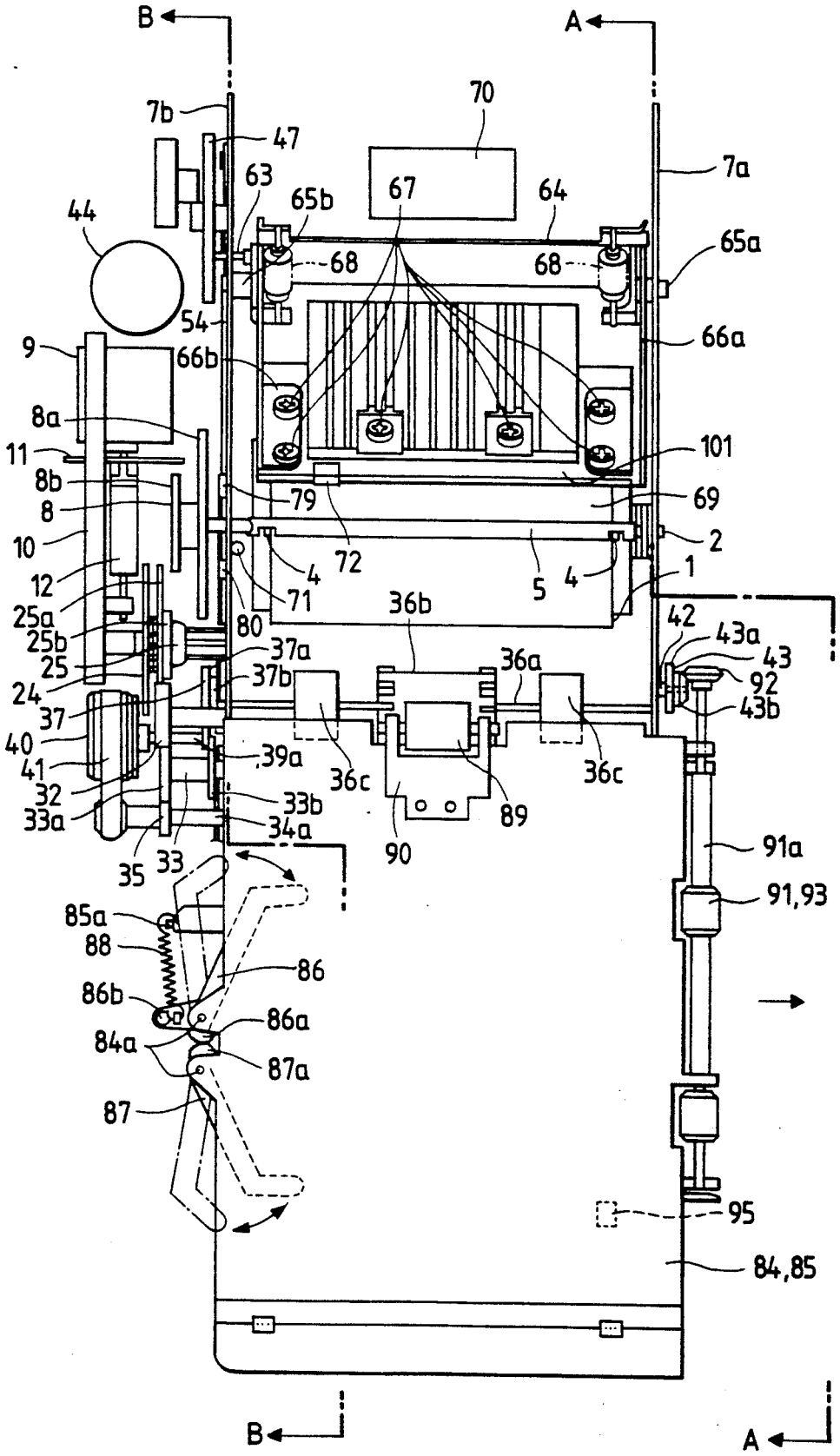
FIG. 1 is a schematic plan view of a thermal transfer recording apparatus according to the present invention.
Figure 2:
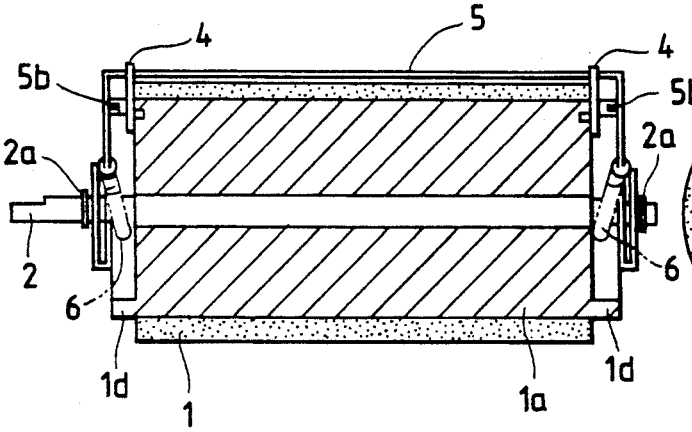
FIG. 2 is a semi-sectional view of a platen roller.
Figure 8:
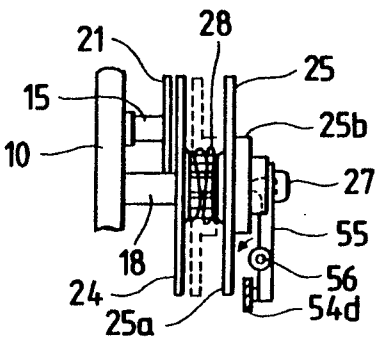
FIG. 8 is a schematic view showing a change-over gear and operation of the same.

Referring to FIG. 1, the platen roller 1 is supported for rotation around an axis of the shaft 2 between a pair of chassis 7*a* and 7*b* appearing at an upper portion of FIG. 1, and a platen gear 8 appearing at a left portion of FIG. 1 for transmitting rotation is fixed to an end of the shaft 2 and has a two-stage construction of a large gear 8*a* and a small gear 8*b*. Sub chassis 10 is mounted on the chassis 7*b*, and a motor 9 serving as a driving source for a rotary system is secured to the sub chassis 10 using a pair of pawl portions 10*a* shown in FIG. 6. A slit plate 11 having slits equidistantly formed thereon is securely mounted on a rotary shaft of the motor 9. Thus, a driving circuit (not shown) controls the rotational speed of the motor 9 in response to a sensor 13 mounted on the sub chassis 10. The slit plate 11 and a worm gear 12 are connected to receive turning force of the motor 9. Shafts 14, 15, 16, 17, 18 and 19 are mounted on the sub chassis 10, and a worm wheel gear 20, a first intermediate gear 21, an ink paper takeup reel receiver 22, an ink paper supplying reel receiver 23, a change-over gear 24 and a locking arm 26 are mounted for rotation or pivotal motion on the shafts 14 to 19, respectively. The worm wheel gear 20 includes a three-stage gear comprising a large gear 20*a*, a middle gear 20*b* with a small gear 20*c*, and the large gear 20*a* being held in engagement with the worm gear 12 while the middle gear 20*b* is held in engagement with the first intermediate gear 21 to transmit rotational driving force of the worm wheel gear 20 to the ink paper takeup reel receiver 22. The small gear 20*c* is engageable with the change-over gear 24 to transmit rotation thereof to the latter. A view of detailed construction of the change-over gear 24 is shown in FIG. 8. Referring to FIG. 8, a slide gear 25 fitted on the change-over gear 24 with a spring 28 interposed therebetween has the same center of rotation as the change-over gear 24 and is mounted for sliding movement in an axial direction of and for normal integral rotation with the change-over gear 24. The slide gear 25 is constituted from a two-stage gear of a large gear 25*a* and a small gear 25*b* which are engageable with the large gear 8*a* and small gear 8*b* of the platen gear 8, respectively. An arresting member 27 for the slide gear 25 which is urged by the spring 28 is securely mounted at an end portion of the shaft 18.

Figure 7:
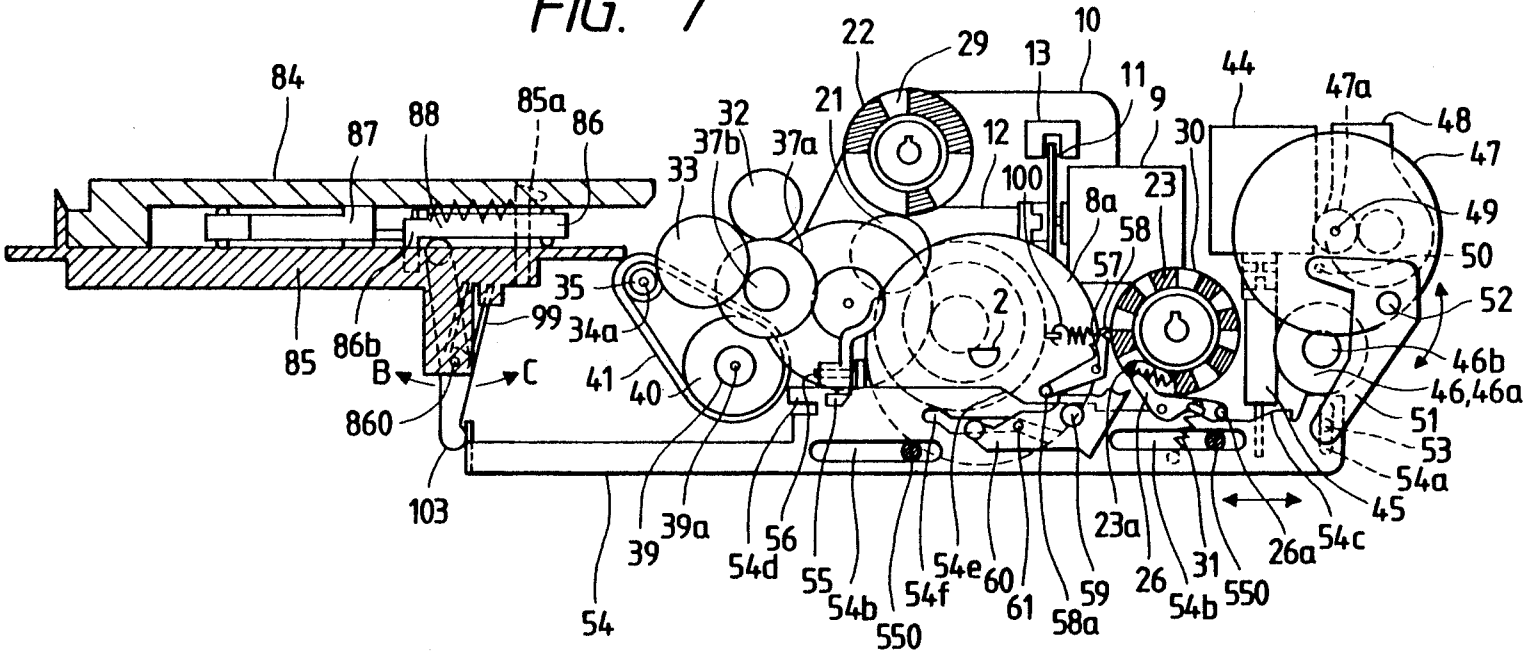
FIG. 7 is a sectional view taken along line B—B in FIG. 1 showing a driving system of the apparatus.

The ink paper takeup reel receiver 22 appearing at an upper portion of FIG. 7 is driven by constant frictional rotational torque which is produced by way of a slip mechanism (not shown) in the inside thereof from rotational driving force transmitted from the first intermediate gear 21. Further, three reflecting plates 29 for discriminating a direction of rotation of the ink paper takeup reel receiver 22 by means of a sensor are applied at large, middle and small pattern pitches to the ink paper winding reel receiver 22.

The ink paper supplying reel receiver 23 appearing at a right portion of FIG. 7 is constructed such that fixed brake torque is produced from a slip mechanism (not shown) in the inside thereof, and a plurality of reflecting plates 30 for discriminating rotation of the ink paper supplying reel receiver 23 are applied in equal pitch patterns on the ink paper supplying reel receiver 23. Here, frictional torque of the ink paper supplying reel receiver 23 is set such that it has a lower value than frictional torque of the ink paper takeup reel receiver 22. A locking spring 31 extends between the sub chassis 10 and the locking arm 26 for engaging with a locking pawl 23*a* securely mounted on the ink paper supplying reel receiver 23 appearing at a right lower portion of FIG. 7. When the slide gear 25 appearing at a right middle portion of FIG. 1 is moved toward the change-over gear 24, the large gear 25*a* is engaged with a second intermediate gear 32 mounted for rotation on a shaft (not shown) mounted on the chassis 7*b* while the second intermediate gear 32 is engaged with a first stage gear 33*a* of a two-stage gear 33 provided in a similar manner.

Figure 9:
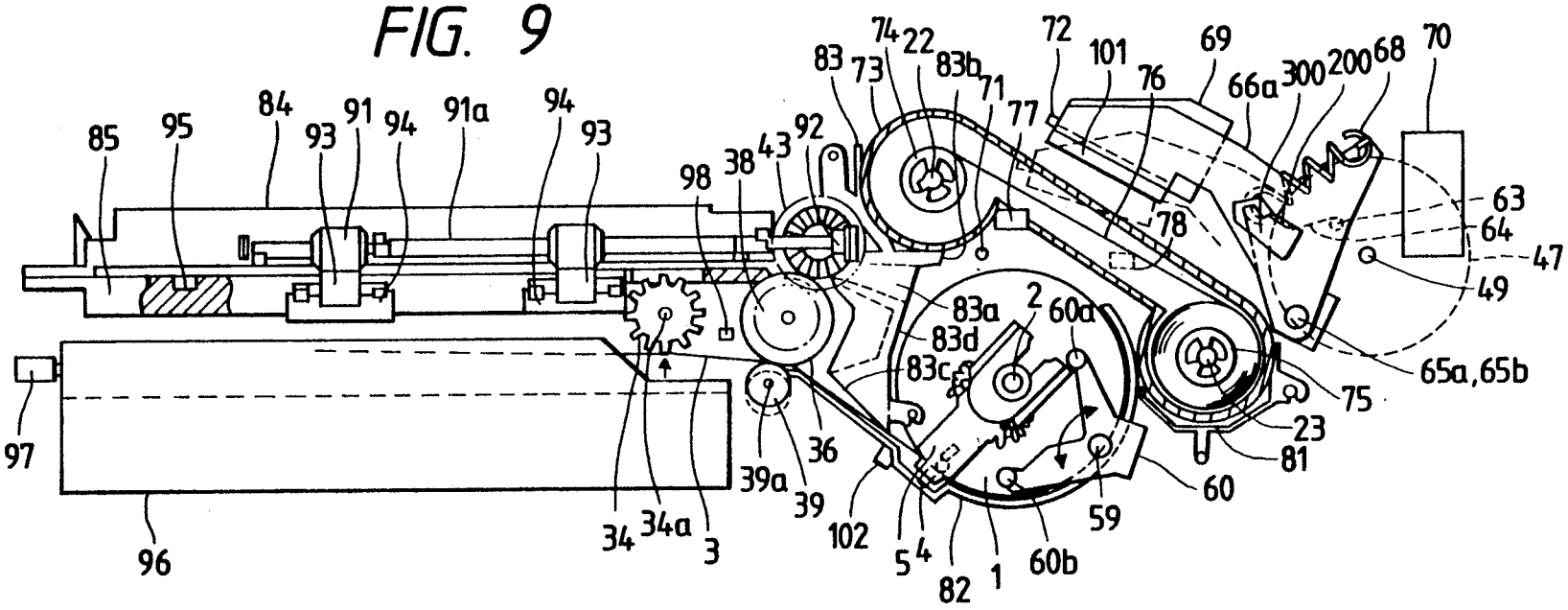
FIG. 9 is a sectional view taken along line A—A of FIG. 1 showing a paper supplying condition of the apparatus.

A pickup roller 34 (FIG. 9) includes a shaft 34*a* around which a rubber member is fixedly mounted such that it has an outer periphery of an uneven profile. The pickup roller 34 is supported for rotation between the chassis 7*a* and 7*b*, and a pulley gear 35 for obtaining rotational driving force is securely mounted at an end of the shaft 34*a* shown at a middle left portion in FIG. 1. A feed roller 36 (FIG. 1) includes a shaft 36*a* around a central portion of which a cylindrical rubber roller 36*b* having a pair of projected portions at the opposite ends thereof is securely mounted by molding, and a pair of cylindrical rubber members 36*c* are securely mounted at the opposite ends of the rubber rollers 36*b* by molding. Further, a feed gear 37 for obtaining rotational driving is securely mounted with construction of a two-stage gear of a large gear 37*a* and a small gear 37*b* at an end of the shaft 36*a* which is supported for rotation between the chassis 7*a* and 7*b*, and a paper discharging gear 38 for transmitting driving force is securely mounted at the other end of the shaft 36*a* (FIG. 9.) A separating roller 39 includes a shaft 39*a* around which a rubber member for contacting with the cylindrical rubber member 36*c* of the feed roller 36 (FIG. 1) is securely mounted in a cylindrical profile by molding. The separating roller 39 is supported for movement to a position indicated by broken lines in FIG. 9 and also for rotation. A coupling 40 (FIG. 1) wherein fixed rotational torque acts by a slip mechanism in the inside is provided at an end of the shaft 39*a*.

The first stage gear 33*a* of the two-stage gear 33 appearing at a middle left portion of FIG. 1 is engaged with the pulley gear 35 which transmits rotational driving force by way of the coupling 40 and a rubber belt 41. The second stage gear 33*b* of the two stage gear 33 is engaged with the small gear 37*b* of the feed gear 37 to rotate the feed roller 36. The large gear 37*a* of the feed gear 37 is engaged with the small gear 25*b* of the slide gear 25 when the slide gear 25 is moved toward the chassis 7*b*. The paper discharging gear 38 (FIG. 9) is held in engagement with a spur gear 43*a* of a third intermediate gear 43 mounted for rotation on a shaft 42 (FIG. 1) FIG. 1 implanted on the chassis 7*a* of FIG. 1. The third intermediate gear 43 is a two-stage gear including a spur gear 43*a* and a bevel gear 43*b*. A worm gear 45 is connected such that rotation of a rotary shaft of a second motor 44 (FIG. 7) for changing over the operating position of the apparatus is transmitted thereto. The worm gear 45 is engaged with a large gear 46*a* of a speed reducing gear 46 mounted for rotation on a shaft (not shown) while a small gear 46*b* transmits driving force to a cam gear 47 which is provided for rotation on a shaft 49 implanted on the chassis 7*b* to determine the operating position of the apparatus. A small gear 47*a* is provided on the cam gear 47 and held in engagement with a rotary change-over switch 48.

The change-over switch 48 is connected to a driving circuit for the second motor 44 and is constructed such that rotation of the motor 44, driven in accordance with any operation mode, may be stopped in response to a statement signal of a designated position.

The second motor 44, speed reducing gear 46 and change-over switch 48 are mounted on a bracket (not shown) and installed on the chassis 7*b*.

First and second grooves (not shown) are formed on a face of the cam gear 47, and a pin 50 for engaging with the first groove is provided on an arm 51. The arm 51 is mounted for pivotal motion around a fulcrum 52 on the chassis *7b*, and a pin 53 is provided at a position of the arm 51 at which a movement of the pin 50 is magnified. The pin 53 is held in fitting engagement in an elongated hole 54*a* of a slider 54 for performing a changing over operation of the apparatus. The slider 54 is constructed for movement in the direction indicated by an arrow A in FIG. 7 on the chassis *7b* by a pair of guide grooves 54*b* which fit with guide shafts 550 implanted on the chassis *7b*. An uneven portion 54*c* for contacting with the cylindrical projected portion 26*a* of the locking arm 26 is formed on the slide 54 for pivoting the locking arm 26. Shafts 56 and 57 are provided on the chassis *7b*, and a change-over arm 55 and a platen locking arm 58 are mounted for pivotal motion on the shafts 56 and 57, respectively. An end of the change-over arm 55 is contacted with the slide gear 25 so that it can be pivoted toward the shaft 18. Meanwhile, the other end of the change-over arm 55 is contacted with an uneven portion 54*d* for the change-over arm provided on the slider 54 so that the change-over arm 55 can obtain a necessary amount of pivotal motion. An end of the platen locking arm 58 appearing at a right middle portion of FIG. 7 has a projected portion provided thereon for engaging with root portions between teeth of the large gear *8a* and is urged toward the large gear *8a* by a platen locking spring 100 extending between the platen locking arm 58 and the chassis *7b* while the other end of the platen locking arm 58 has a cylindrical projected portion 58*a* provided thereon for contacting with an uneven portion 54*e* provided on the slider 54.

A K shaped arm 60, serving as driving means for the fixing arms 5, is mounted for pivotal motion around the fulcrum 59 between the chassis *7b* and *7a* and has a pin 61 provided thereon for fitting with a pivoting hole 54*f* provided on the slider 54.

Ends 60*a*, 60*b* (FIG. 9) of the K shaped arm 60 are constructed such that they are contacted, depending upon positions at which the fixing arms 5 are stopped, with the fixing arms 5 to cancel pressing force of the fixing arms 5.

A pivot shaft 65 provided on a head arm 66*b*, extends through a driving arm 64 on which a head pin 63 for fitting with the second groove of the cam gear 47 (FIG. 1) is provided for supporting to the driving arm 64 for pivotal motion, and another pivot shaft 65*a* is provided on the driving arm 64 (FIG. 1) and extends for rotation through the head arm 77*a*. The pivot shafts 65*a* and 65*b* are supported for rotation between the chassis *7a* and *7b*, and a thermal head 101 is secured to the head arms 66*a* and 66*b* by screws 67, and a heat radiating plate 69 is secured to the thermal head 101 by screws 67. A cooling fan 70 is provided for the thermal head 101, with the cooling fan 70 being secured between the chassis *7a* and *7b* by a bracket (not shown). A head spring 68, pressing the thermal head 101 with a fixed force against the platen roller 1, extends between each of the head arms 66*a* and 66*b* and the driving arm 74. In order to cancel the pressing force of the thermal head 101, a convex projected portion 200 of the driving arm 64 contacts hole portions provided in the head arms 66*a* and 66*b*.

A light emitting element 71 emits light of a fixed wavelength, and a light receiving element 72 receives such light, with the light emitting element 71 and light receiving element 72 being provided at an end of the thermal head 101 such that light may pass through ink paper 75 wound around a takeup reel 74 and a supply reel 75 in an ink paper cartridge 73.

The ink paper 76 has, though not shown, inks of three colors of yellow, magenta and cyan applied successively to a base film thereof, and light of the light emitting element 71 passes through the yellow and magenta, but the ink of the cyan is composed of components which do not permit light to pass therethrough.

After the ink paper cartridge 73 is mounted on the apparatus, the takeup reel 74 and supply reel 75 are engaged, through holes (not shown) perforated in the ink paper cartridge 73, with the ink paper takeup reel receiver 22 and ink paper supplying reel receiver 23 to being coupled to each other for integral rotation. Switches 77, 78 delect an outer profile of the ink paper cartridge 73, and the switches 77 and 78 effect determination of presence or absence of an ink paper cartridge in the apparatus, or in the case of the ink paper cartridge 73 wherein the ink paper 76 of a different characteristic is wound, the outer profile is modified partially such that it is detected by the switches 77 and 78 so that a controlling circuit not (shown) may select a printing condition conforming to the characteristic of the ink paper.

Sensors 79, 80 (FIG. 1) detect a position of the platen roller 1, and the sensors 79 and 80 are provided on the platen gear 8.

A supply side guide 81 (FIG. 9) guides the ink paper cartridge 73 upon loading, and the supply side guide 81 is profiled so as to guide the record paper 3 along part of an outer periphery of the platen roller 1.

A transport guide 82 (FIG. 9) is provided, and a sensor 102 for discriminating whether or not the record paper 3 is transported thereto is mounted on the transport guide 82 forwardly of a position at which the record paper 3 and the stopper 4 are brought into contact with each other upon paper feeding.

A takeup side guide 83 (FIG. 9) is provided, for the ink paper cartridge 73, and a discharging opening 83*a* used when the record paper 3 is discharged, is provided in the takeup side guide 83. The takeup side guide 83 further has formed thereon a guide portion 83*c* for guiding the ink paper cartridge 73 upon supplying of the record paper 3 and another guide portion 83*d* for guiding the ink paper cartridge 73 when the record paper 3 is transported by the platen roller 1. Further, an engaging portion 83*b* engageable with the takeup side guide 83 and fixing arm 5 when the fixing arm 5 is pushed up by the platen roller 1 upon discharging of the record paper 3, is provided on the takeup side guide 83. The supply side guide 81, transporting guide 82 and takeup side guide 83 are provided and secured between the chassis *7a* and *7b*.

An upper side guide member 84 and a lower side guide member 85 (FIG. 7) for guiding discharged record paper (not shown) are provided in combination. A shaft 860 is provided on the lower guide member 85, and a paper discharging pivotal arm 103 is mounted for pivotal motion on the shaft 860 for contacting engagement with the slider 54. A torsion spring 99 is provided between the paper discharging arm 103 and the lower guide member 85 and urges the paper discharging arm 103 toward the slider 54.

A pair of pivotal arms 86 and 87 for changing the direction of record paper (not shown) are fitted for pivotal motion in a hole 84*a* provided in the upper side guide member 84 (FIG. 1) and another hole (not shown) is provided in the lower guide member 85 in an opposing relationship to the hole 84*a*, respectively, between the upper guide member 84 and lower guide member 85 and further for engaging with gear portions 86*a* and 87*a*, respectively.

A cylindrical portion 86*b* for contacting the paper discharging pivotal arm 103 (FIG. 7) is provided on the one pivotal arm 86, and an arm spring 88 extends between the cylindrical portion 86*b* and a hooked portion 85*a* provided on the lower side guide member 85.

A spring member 90 for applying contacting force to a roller 89 which is contacted with and rotated by the rubber roller 36*b* at the central portion of the feed roller 36 is secured to the upper side guide member (FIG. 1) and a shaft 91*a* of a discharging roller 91 for discharging record paper (not shown) from the apparatus is supported for rotation on the upper side guide member 84. A bevel gear 92 is securely mounted at an end of the shaft 91*a* and held in engagement with the bevel gear 43*b* of the third intermediate gear 43 to transmit rotational driving force changing the direction of axis of rotation by 90 degrees.

An auxiliary roller 93 in contact with and rotated by the paper discharging roller 91 (FIG. 9) obtains a contacting force from a leaf spring 94 provided on the lower side guide member 85.

A sensor 95 detects record paper 3 discharged between the upper and lower guide members 84 and 85, with the sensor 95 being mounted on the lower guide member 85.

A tray 96 (FIG. 9) is provided for the record paper 3, a switch 95 detects presence or absence of the tray 96, and a sensor 98 determines presence or absence, overlapping feeding and type of the record paper 3.

In order to perform a printing operation, an ink cartridge 73 and a record paper tray 96 shown in FIG. 9 are first loaded in position into the apparatus, whereupon the switches 77 and 78 disposed in an area of the ink paper cartridge 73 and the switch 97 (FIG. 9) each transmit a signal of completion of loading to the controlling circuit (not shown), and the apparatus enters a standby condition. Then, if a print button (not shown) is depressed, the second motor 44 (FIG. 7) is activated so that the cam gear 47 is rotated by the speed reducing gear 46. Then, after the change-over switch 48 is changed to a position for a paper supply mode, operation of the motor 44 is stopped. By such operation, the arm 51 (FIG. 7) is pivoted in the leftward direction to move the slider 54. By such movement of the slider 54, the supply side reel receiver 33 is fixed by the locking pawl 23*a* and locking arm 26, and the platen large gear 8*a* (FIG. 7) and the platen locking arm 58 are engaged with and fixed by each other in order that the platen roller 1 may not be rotated when the record paper 3 is in contact with the stoppers 4 of FIG. 10. Meanwhile, when the change-over arm 55 is pivoted in the direction of an arrow in FIG. 8 to the broken line position, the large gear 25*a* of the slide gear 25 is engaged with the second intermediate gear 32 (FIG. 7) while the small gear 25*b* of the slide gear 25 is not engaged with any gear. Consequently, the rotation transmitting system to the platen roller 1 is interrupted. In addition, the paper discharging pivotal arm 103 is pivoted in the direction of an arrow B by the slider 54 of FIG. 7, and the pivotal arms 86 and 87 (FIG. 1) are pivoted to the broken line positions by the urging of the arm spring 88 while the K shaped arm 60 of FIG. 9 is pivoted in the counterclockwise direction until the fixing arm 5 and the end 60*a* of the K shaped arm 60 are contacted with each other to move the fixing arm 5 away from the outer periphery of the platen roller 1. Meanwhile, though not shown, the K shaped arm 60 is operated together with the slider 54 so that the record paper 3 in the tray 96 is pressed against the pickup roller 34 (FIG. 1) only in a paper supply mode. In the paper supplying condition described so far, the motor 9 of FIG. 7 is rotated subsequently to guide the record paper 3 (FIG. 9) toward a position between the outer periphery of the platen roller 1 and the fixing arm 5 by the transporting guide 82 to effect positioning of the record paper 3 with respect to the platen roller 1. The apparatus in this condition is shown in FIG. 9, and a detailed view of the fixing arm 5 and the record paper 3 then is shown in FIG. 10.

Here, the discrimination whether or not the record paper 3 is in contact with the stoppers 4 can be effected readily if the controlling circuit (not shown) for the motor 9 of FIG. 7 is driven if the time until the record paper 3 is contacted with the stoppers 4 after the sensor 102 appearing at a lower portion of FIG. 9 has detected the record paper 3 is taken into consideration.

Figure 10:
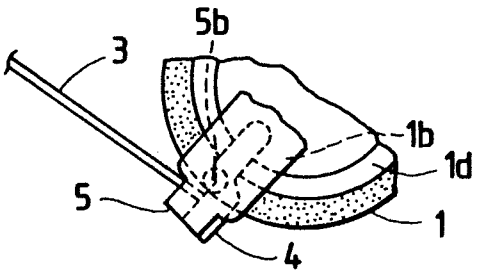
FIG. 10 is an enlarged view of part of the platen roller shown in FIG. 9.

After the record paper 3 is in contact with the stoppers 4 in FIG. 10, the motor 9 of FIG. 7 is stopped while the second motor 44 (FIG. 7) is rotated. Consequently, the apparatus changes from the paper supply mode into an ink paper initializing mode similarly as in the operation described above.

By the movement, the slider 54 is moved in the rightward direction of FIG. 7, and in the ink paper initializing mode, the locking arm 26 is pivoted to cancel the fixation of the supply reel receiver 23. The platen roller remains in a fixed condition similarly as in the paper supply mode described above; the slide gear 25 is similarly operated as in the paper supply mode described above, and the paper discharging pivotal arm 103 is released from contact with the slide 54 and the urging force of the torsion spring 99 overcomes the arm spring 88 to pivot the paper discharging pivotal arm 103 in the direction of the arrow C in c FIG. 7 to pivot the pivotal arms 86 and 87 to positions of alternate long and short dash lines of FIG. 1. The K shaped arm 60, (FIG. 9) is pivoted to a position at which it does not contact the fixing arm 5 to fix the record paper 3 on the outer periphery of the platen roller 1 with the fixing arm 5. Further, the driving arm 64 is pivoted by the second groove of the cam gear 47 to lower the thermal head 101 to the broken line position of FIG. 9.

If the motor 9 of FIG. 7 is rotated subsequently in the ink paper initializing mode condition described so far, since slip torque of the ink paper takeup reel receiver 22 at an upper portion of FIG. 9 is greater than brake torque of the ink paper supplying reel receiver 23, the ink paper 76 is wound onto the takeup reel 74.

Thereupon, as light from the light emitting element 71 is received by the light emitting element 72 by way of the ink paper 76, a boundary between a yellow portion and a cyan portion having different light transmission factors is detected to effect heading of a yellow portion for the first color.

After such heading is completed, the motor 9 of FIG. 7 is stopped while the second motor 44 is rotated. Consequently, the apparatus changes from the ink paper initializing mode to a record paper transporting mode similarly to the operation described above. Thereupon, the slider 54 is moved, and in the record paper transporting mode, the locking arm 26 at a right lower portion of FIG. 7 fixes the supplying reel receiver 23. The platen locking arm 58 cancels the fixation of the platen gear large gear 8*a* and the large gear 25*a* of the slide gear 25 of FIGS. 1 and 8 is engaged with the platen gear small gear 8*b* and second intermediate gear while the small gear 25*b* of the slide gear 25 is not engaged with any gear due to a relationship between the spring 28 and a portion 54*d* of the slider 54 with which the change-over arm 55 is contacted. The paper discharging pivotal arm 103 at a left portion of FIG. 7, the K shaped arm 60 and the thermal head 101 are position in a similar manner to the ink paper initializing mode described above.

If the motor 9 of FIG. 7 is rotated subsequently in the record paper transporting mode condition described so far, then the platen roller 1 is rotated with the record paper 3 fixed thereto by the fixing arms 5, and if the sensor 80 (FIG. 1) detects a detection portion (not shown) provided on the platen gear 8, then the motor 9 is stopped while the second motor 44 of FIG. 9 is rotated. Consequently, the apparatus changes over from the record paper transporting mode to a printing mode in a manner similar to the operation described above. Thereupon, the slider 54 is moved, and in the printing mode, the fixation of the supplying reel receiver 23 is cancelled the platen locking arm 58 is released similarly as in the record paper transporting mode described above, and the slide gear 25 is moved to a position shown in FIG. 8 due to a relationship between the spring 28 and the portion 54*d* of the slider 54 with which the change-over arm 55 is contacted, and the small gear 25*b* at a left portion of FIG. 1 is engaged with the platen gear large gear 8*a* and the feed gear large gear 37*a* while the large gear 25*a* is not engaged with any gear. The paper discharging pivotal arm 103 and the K shaped arm 60 are positioned in a similar manner as in the record paper transporting mode described above.

Figure 11:
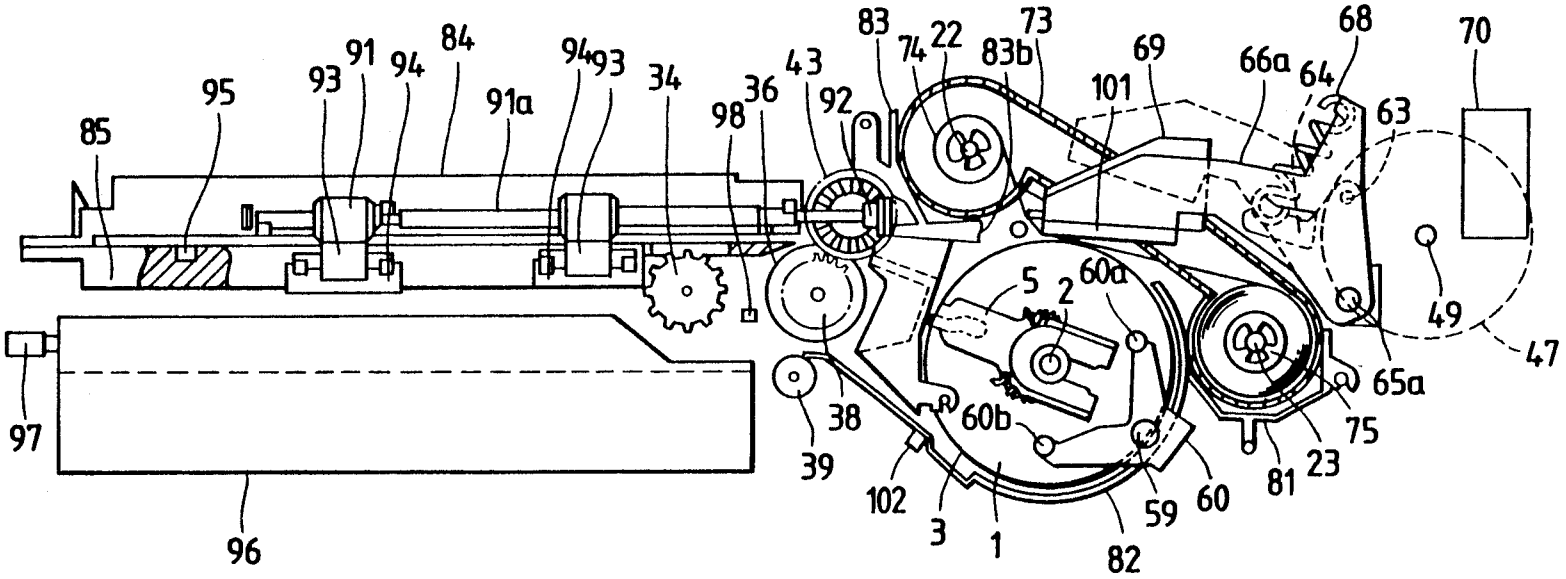
FIG. 11 is a front elevational view showing a printing condition of the apparatus.

The driving arm 64 is pivoted by the second groove of the cam gear 47 and the thermal head 101 of FIG. 11 presses the ink paper 76 and record paper 3 in an overlapping relationship against the platen roller 1.

Figure 12:
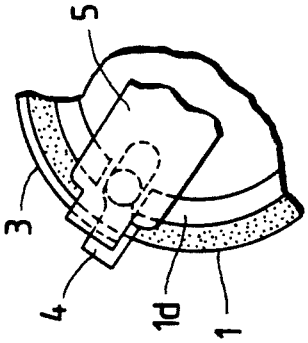
FIG. 12 is an enlarged view of part of the platen roller shown in FIG. 11.

If the motor 9 of FIG. 7 is rotated subsequently in the printing mode condition described so far, then energization of the thermal head 101 of FIG. 9 is started simultaneously by the controlling circuit (not shown) and a printing operation is performed and the condition of FIG. 11 is entered. FIG. 12 is a detailed view of the record paper 3 and fixing arm 5 then. Here, the energization pitch of the thermal head 101 is synchronized with a driving amount of the platen roller 1 as the sensor 13 detects the slit plate 11 securely mounted on the rotary shaft of the motor 9 of FIG. 7.

In this instance, the ink paper 76 and record paper 3 of FIG. 9 are fed integrally by the platen roller 1, and the ink paper 76 after use is separated from the record paper 3 at an end portion of the thermal head 101 and is wound up onto the takeup reel 74 by the takeup reel receiver 22. It is to be noted that brake torque exerted by a click mechanism provided on the supplying reel receiver 23 is applied as back tension to the ink paper 76 to effect prevention of occurrence of wrinkles on the ink paper 76. Meanwhile, the record paper 3 is guided by the guide members 81, 82 and 83 so as to extend along the platen roller 1.

After printing of a predetermined amount of the first color (yellow) is completed, energization of the thermal head 101 is stopped, but transportation of the record paper 3 and ink paper 76 by the pressing of the thermal head 101 continues while heading of a second color (magenta) is performed and separation of the record paper 3 and ink paper 76 after printing is effected. After the two operations are completed, the motor 9 is stopped while the second motor 44 is rotated. Consequently, the apparatus changes over from the printing mode to a record paper transporting mode similarly to the operation described above. After that, the third color (magenta) and a third color (cyan) are printed similarly as in the operation described above. After completion of printing of the third color, the platen roller 1 is rotated in the record paper transporting mode, and the motor 9 is stopped while the second motor 44 is rotated in response to the sensor 80 at a left portion of FIG. 1 similar to the operation described above. Consequently, the apparatus changes over from the record paper transporting mode to a record paper discharging mode similarly as in the operation described above. In this instance, the slider 54 at a lower portion of FIG. 7 is moved, and in the record paper discharging mode, the supplying reel receiver 23 is fixed by the locking arm 26. The platen locking arm 58 is released similarly as in the record paper transporting mode described above, and the slide gear 25 is engaged with the platen gear 8 in a similar condition as in the printing mode described above. The K shaped arm 60 at a lower portion of FIG. 7 is pivoted by the pivotal arm 54*f* of the slider 54, and, as the fixing arm 5 at a lower portion of FIG. 9 and an end 60*b* of the K arm 60 are brought into contact with each other, the fixing arm 5 is moved away from the outer periphery of the platen roller 1 to cancel the fixation of the record paper 3.

In this instance, the projected portions 5*b* of the fixing arm 5 of FIG. 10 are removed from the recessed portions 1*b* of the platen roller 1 and moved to positions on the outer periphery of the projected ribs 1*d*.

The paper discharging pivotal arm 103 (FIG. 7) and the thermal head 101 of FIG. 9 are similar as in the printing mode described above.

Figure 13:
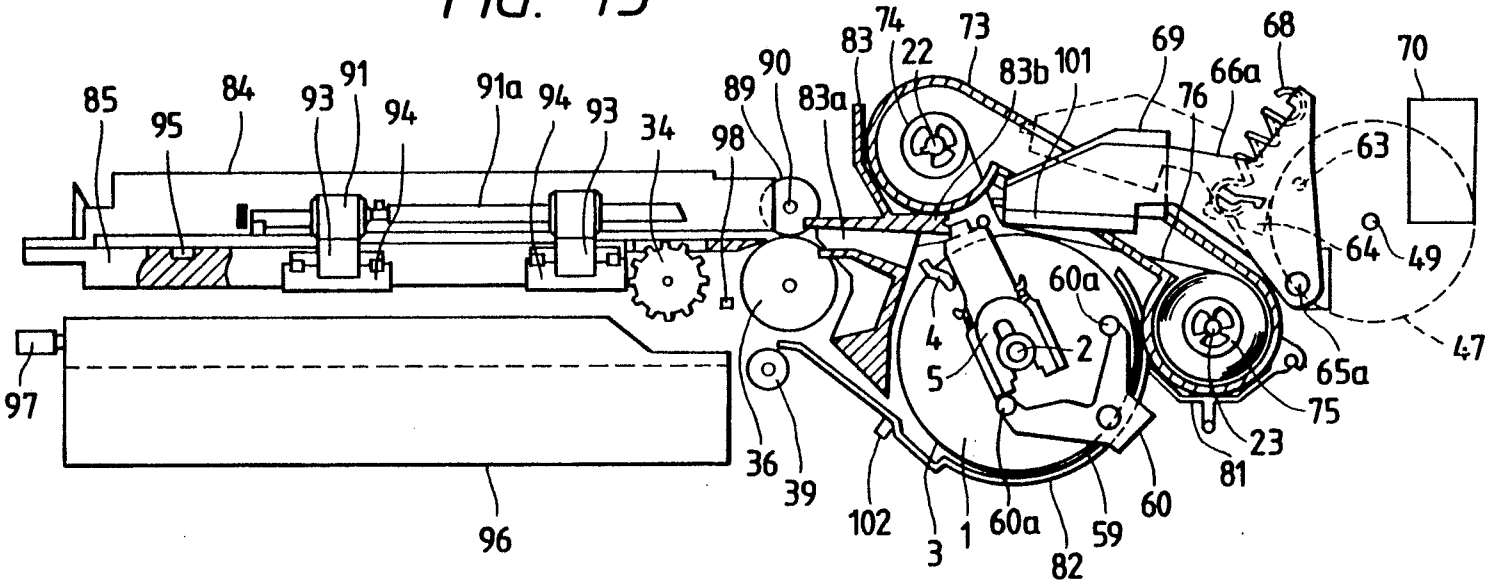
FIG. 13 is a front elevational view showing a discharging condition of the apparatus.
Figure 14:
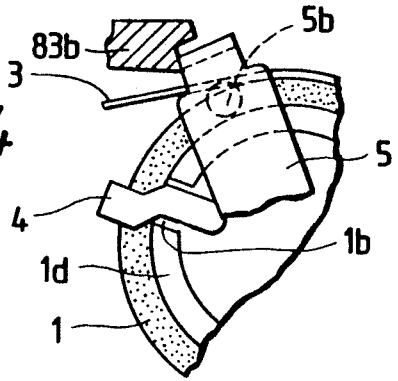
FIG. 14 is an enlarged view of part of the platen roller shown in FIG. 13.

FIG. 13 shows an operational view of the apparatus when pivotal motion of the platen roller proceeds until the fixing arm and the takeup side guide are contacted with each other, and FIG. 14 is an enlarged view of such contacting portions.

If the motor 9 is rotated in the record paper discharging mode, the fixing arm 5 is contacted and engaged with the engaging portion 83*b* of the takeup side guide 83 as shown in FIG. 13, and the projected portions 5*b* of the fixing arm 5 of FIG. 14 are contacted with the outer periphery of the projected ribs 1*d* of the platen roller 1 so that the gap between the platen roller 1 and the fixing arm 5 is kept constant. The record paper 3 is thus transported to the discharging opening 83*a* of the takeup side guide by the platen roller 1 under pressing force of the thermal head 101.

Further, the motor 9 of FIG. 1 is rotated to contact the record paper (not shown) with the rubber roller 36*b* at the central portion of the feed roller, and the motor 9 is stopped after the record paper is transported until it is caught by the roller 89 which is being rotated. Detection of the position of the record paper then can be effected readily by the driving circuit (not shown) if rotation of the slit plate 11 mounted on the motor 9 is detected by the sensor 13 of FIG. 7. Further, while the ink paper 76 at a right portion of FIG. 13 is fed together with the record paper 3, the length of the third color is determined such that a succeeding first color may not appear even by such feeding.

Subsequently, the motor 44 of FIG. 7 is rotated to change over the apparatus from the record paper discharging mode to a record paper transporting mode. Thereupon, the slider 54 is moved, and the apparatus is put into a similar condition as in the record paper transporting mode described above. If the motor 9 is rotated in this condition, the record paper is transported by the rubber roller 36*b* at the central portion of the feed roller of FIG. 1 and the roller 89 and is discharged between the upper and lower guide members 84 and 85. Thereupon, since the pivotal arms 86 and 87 are positioned at the positions indicated by alternate long and short dash lines in FIG. 1, they will not be contacted with the record paper. Further, when the platen roller 1 makes one rotation in FIG. 14, the projected portions 5*b* of the fixing arm 5 are fitted with the recessed portions 1*b* of the platen roller 1 by the urging force of the springs (not shown) and press against the platen roller 1.

When a fixed interval of time passes after the sensor 95 has detected the record paper (not shown) in FIG. 13, the motor 9 is stopped. Thereupon, a rear end of the record paper has been discharged completely to a position between the upper and lower guide members 84 and 85, and the position of the platen roller 1 of FIG. 1 is stopped at a position of the paper supplying mode when the detection portion of the platen gear 8*a* is detected by the sensor 79.

Subsequently, the second motor 44 is rotated so that the apparatus is moved from the record paper transporting mode to a standby mode similarly to the operation described above. Thereupon, the slider 54 of FIG. 7 is moved, and in the standby mode, the supplying reel receiver 23 is fixed by the locking arm 26. The platen roller 1 is fixed by the platen locking arm 58 and the slide gear 25 of FIG. 8 is moved to the same position as in the paper supplying mode, in short, the broken line position of FIG. 8. The K shaped arm 60 is positioned in a similar manner as in the record paper transporting port described above. The thermal head 101 is moved up to the position shown in FIG. 9. The paper discharging pivotal arm 103 is brought into contact with the slider 54 to pivot the latter in the direction of the arrow B in FIG. 7 to thereby pivot the pivotal arm 86 and 87 to the broken line positions shown in FIG. 1 similarly as in the ink paper initializing mode described above. The record paper (not shown) between the upper and lower guide members 84 and 85 is pressed against the discharging roller 91 by the pivotal arms 86 and 87 of FIG. 1.

If the motor 9 is rotated subsequently in the standby mode described so far, then the record paper is transported by the discharging roller 91 and auxiliary roller 93 and discharged outside the apparatus. In this instance, after a fixed interval of time after the sensor 95 which is detecting the record paper detects that the record paper has disappeared, the motor 9 is stopped, thereby ending all operations.

As described so far, according to the present invention, when record paper is supplied, turning power to the platen roller is interrupted, and further, pivotal motion of the platen roller is prevented. Consequently, the record paper can be transported stably to the record paper fixing mechanism section on the outer periphery of the platen roller using the motor for the rotational driving of the platen roller. Accordingly, an inexpensive thermal transfer recording apparatus can be provided which can print with a high degree of accuracy with a small number of mechanical parts and circuit parts without the necessity of a motor for the exclusive use for supplying and discharging of paper or the like.

What is claimed is:

1. A thermal transfer recording apparatus wherein a recording paper and an ink paper positioned on the recording paper are heated from above the ink paper using a thermal head to effect recording on the recording paper, the apparatus comprising:

a platen roller having a clamping mechanism for clamping the recording paper;

means for transporting the recording paper to said clamping mechanism;

platen roller locking means for preventing a rotation of said platen roller;

a motor; and power transmitting means for transmitting a torque of said motor, said power transmitting means having a first position at which no torque is applied to said platen roller and a second position at which the torque is applied to said platen roller while no torque is applied to said means for transporting the recording paper, and wherein said power transmitting means is moved to said first position and said platen roller locking means prevents the rotation of said platen roller when the recording paper is to be transported to said clamping mechanism.

2. A thermal transfer recording apparatus according to claim 1, wherein said platen roller locking means prevents a rotation of a driving gear secured to a shaft of said platen roller.

* * * * *